United States Patent [19]

Smith

[11] Patent Number: 4,529,441

[45] Date of Patent: Jul. 16, 1985

[54] ELECTRICAL STEELS

[75] Inventor: Brian Smith, Cardiff, Wales

[73] Assignee: British Steel Corporation, London, England

[21] Appl. No.: 648,320

[22] Filed: Sep. 7, 1984

[30] Foreign Application Priority Data

Sep. 19, 1983 [GB] United Kingdom ..... 8324986

[51] Int. Cl.[3] ..... C21C 7/02

[52] U.S. Cl. ..... 75/53; 75/58; 164/473

[58] Field of Search ..... 75/53, 58; 164/473

[56] References Cited

U.S. PATENT DOCUMENTS 4,143,211 3/1979 Obinata ..... 75/53

4,268,305 5/1981 Leclerc ..... 75/53

*Primary Examiner*—Peter D. Rosenberg

*Attorney, Agent, or Firm*—Kinney & Lange

[57] ABSTRACT

The invention provides a continuous cast electrical steel and its method of production from a steel melt having a composition range of up to 0.06% carbon, up to 0.04% sulphur, up to 0.15% phosphorus, up to 1.0% manganese, and not more than 0.001% silicon, the remainder being iron and incidental impurities, a silicon addition being made to the molten metal prior to the continuous casting mould in the range of 0.05% and 0.25%.

7 Claims, No Drawings

ELECTRICAL STEELS

This invention relates to electrical steels particularly electrical steels of the type sometimes known as "non-silicon", of high tonnage production and utilised for example in fractional horse-power motors for domestic appliances, and having a production cost and electrical characteristics appropriate for such utilisation.

Traditionally electrical steels, including this type of electrical steel, have been produced by an ingot mould route usually utilising "bottle type" types of ingot moulds, capped to prevent gas escape during solidification and hence eliminate the problem of upper piping of the ingot. With the type of electrical steel referred to above the steel is usually, in essential constitution, a rimming steel to which minor aluminium additions have been made at least partially to kill the steel and control or reduce the rimming efffect.

It has been proposed that electrical steels of this kind should be continuously cast. In this case it is essential that it be presented to the casting mould in a killed condition to ensure that there is no formation of gas bubbles during casting.

To provide a steel in a satisfactorily killed condition for continuous casting requires significant additions, usually of aluminium, to be made to the steel prior to casting. However, a problem is created in that such significant additions lead to the presence of aluminium compounds in the steel which have been found to be deleterious to the final magnetic properties of the steel product.

It is an object of the present invention to overcome or at least substantially remove the above mentioned problem.

According to one aspect of the invention there is provided a continuous cast electrical steel produced from a steel melt having a composition range of up to 0.06% carbon, up to 0.04% sulphur, up to 0.15% phosphorus, up to 1.0% manganese, and not more than 0.001% silicon, the remainder being iron and incidental impurities, to which a silicon addition is made to the molten metal prior to the continuous casting mould in the range 0.05% to 0.25%.

According to a second aspect of the present invention there is provided a method of manufacturing continuous cast electrical steel including the steps of producing a melt having a composition range of up to 0.06% carbon, up to 0.04% sulphur, up to 0.15% phosphorus, up to 1.0% manganese, and not more than 0.001% silicon, the remainder being iron and incidental impurities; making a silicon addition to the molten metal in the range of 0.05% to 0.25%; and subjecting the molten metal to continuous casting.

The silicon addition is preferably in the form of ferro-silicon.

We have found a convenient level of silicon addition to be approximately 0.15%. The ferro-silicon addition may be made in the ladle above the casting mould.

We have found that the addition of silicon within the range specified effectively achieves the necessary killed steel condition without the deleterious effect of aluminium additions. Thus we have found it enough fully to kill the steel and not great enough to degrade the magnetic permeability of the final product, nor to change the properties of the steel to a "low-silicon" type of electrical steel.

We have found that the use of ferro-silicon in the manner of the invention improves the cleanliness of the steel, and in addition improves the magnetic properties so far as hysteresis and eddy current power losses (for example) are concerned in electrical equipment utilising the steel.

The composition range of the steel may include up to 0.04% carbon and up to 0.03% sulphur.

In order that the invention may be more readily understood, examples thereof will now be described as follows:

EXAMPLE 1

A cast of Steel having a ladle analysis of 0.021% carbon, 0.010% sulphur, 0.64% manganese, 0.057% phosphorus, 0.015% aluminium, and 0.19% silicon was cast into slabs and rolled to 1.9 mm thick hot band.

The hot rolled coils were descaled by pickling and cold rolled to 0.55 mm thickness. The coils were annealed using a continuous annealing process and finally cold rolled to 0.50 mm thickness.

Epstein samples, cut from sample sheets and taken from random coils, were annealed at 780° C. for 1 hour in a decarbonising atmosphere. The magnetic properties of this material were measured using 25 cm double overlap Epstein testing equipment and gave the following results:

| | Magnetic Properties | |
|---|---|---|
| Sample No. | Specific total loss at B = 1.5 Tesla and at 50 Hz (W/Kg) | B at H = 1.0 kA/m and at 50 Hz (Tesla) |
| 1 | 4.39 | 1.60 |
| 2 | 4.54 | 1.59 |
| 3 | 4.61 | 1.58 |
| 4 | 4.30 | 1.61 |

EXAMPLE 2

A cast of Steel having a ladle analysis of 0.041% carbon, 0.018% sulphur, 0.58% manganese, 0.087 phosphorus, 0.012% aluminium, and 0.20 silicon was cast into slabs and rolled to 1.9 mm thick hot band.

The hot rolled coils were descaled by pickling and cold rolled to 0.70 mm thickness. The coils were annealed using a batch annealing process and finally cold rolled to 0.65 mm thickness.

Epstein samples, cut from sample sheets and taken from random coils, were annealed at 780° C. for 1 hour in a decarbonising atmosphere. The magnetic properties of this equipment and gave the following results:

| | Magnetic Properties | |
|---|---|---|
| Sample No. | Specific total loss at B = 1.5 Tesla and at 50 Hz (W/Kg) | B at H = 1.0 kA/m and at 50 Hz (Tesla) |
| 1 | 5.49 | 1.58 |
| 2 | 5.45 | 1.58 |
| 3 | 5.15 | 1.59 |
| 4 | 5.55 | 1.57 |
| 5 | 5.40 | 1.58 |
| 6 | 5.54 | 1.57 |

EXAMPLE 3

A cast of Steel having a ladle analysis of 0.024% carbon, 0.013% sulphur, 0.26% manganese, 0.027% phosphorus, 0.020% aluminium and 0.18% silicon was cast into slabs and rolled to 1.9 mm thick hot band.

The hot rolled coils were descaled by pickling and cold rolled to 0.71 mm thickness. The coils were annealed using a continuous annealing process and finally cold rolled to 0.65 mm thickness.

Epstein samples, cut from sample sheets and taken from random coils, were annealed at 780° C. for 1 hour in a decarbonising atmosphere. The magnetic properties of this equipment and gave the following results:

| | Magnetic Properties | |
|---|---|---|
| Sample No. | Specific total loss at B = 1.5 Tesla and at 50 Hz (W/Kg) | B at H = 1.0 kA/m and at 50 Hz (Tesla) |
| 1 | 8.09 | 1.59 |
| 2 | 7.90 | 1.59 |
| 3 | 7.63 | 1.60 |
| 4 | 8.01 | 1.60 |
| 5 | 6.72 | 1.62 |
| 6 | 7.87 | 1.59 |

As can be appreciated from the above, the examples had satisfactory casting characteristics and provided products with good electrical properties.

Overall therefore we have found that the steel produced according to the invention results in excellent magnetic properties without incurring any problem during any stage of manufacture.

I claim:

1. A continuous cast electrical steel produced from a steel melt having a composition range of up to 0.06% carbon, up to 0.04% sulphur, up to 0.15% phosphorus, up to 1.0% manganese, and not more than 0.001% silicon, the remainder being iron and incidental impurities to which a silicon addition is made to the molten metal prior to the continuous casting mould in the range 0.05% and 0.25%.

2. A steel as claimed in claim 1 wherein the silicon addition is in the form of ferro-silicon.

3. A steel as claimed in claim 2 wherein the level of silicon addition is approximately 0.15%.

4. A method of manufacturing continuous cast electrical steel including the steps of producing a melt having a composition range of up to 0.06% carbon, up to 0.04% sulphur, up to 0.15% phosphorus, up to 1.0% manganese, and not more than 0.001% silicon, the remainder being iron and incidental impurities; making a silicon addition to the molten metal in the range of 0.05% to 0.25%; and subjecting the molten metal to continuous casting.

5. A method as claimed in claim 4 wherein the silicon addition is in the form of ferro-silicon.

6. A method as claimed in claim 5 wherein the level of silicon addition is approximately 0.15%.

7. A method as claimed in claim 5 wherein the silicon addition is made in the ladle above the continuous casting mould.

* * * * *